US005425350A

United States Patent [19]

Egusquiza

[11] Patent Number: 5,425,350

[45] Date of Patent: Jun. 20, 1995

[54] PORTABLE BOW PRESS

[76] Inventor: Ralph R. Egusquiza, 723 14th Ave. S., Nampa, Id. 83651

[21] Appl. No.: 158,965

[22] Filed: Nov. 29, 1993

[51] Int. Cl.[6] ..... F41B 5/14

[52] U.S. Cl. ..... 124/86; 124/1

[58] Field of Search ..... 124/1, 23.1, 24.1, 25.6, 124/86, 88

[56] References Cited

U.S. PATENT DOCUMENTS

| | | | |
|---|---|---|---|
| 3,055,655 | 9/1962 | Chelf | 124/86 X |
| 4,074,409 | 2/1978 | Smith | 29/235 |
| 4,077,385 | 3/1978 | Frederickson | 124/25.6 |
| 4,195,397 | 4/1980 | Saunders | 29/235 |
| 4,291,452 | 9/1981 | Whitman et al. | 124/25.6 X |
| 4,599,987 | 7/1986 | Rezmer . | |
| 5,022,377 | 6/1991 | Stevens | 124/23.1 |
| 5,125,389 | 6/1992 | Paff | 124/86 |
| 5,222,473 | 6/1993 | Lint | 124/86 |

*Primary Examiner*—Randolph A. Reese
*Assistant Examiner*—John A. Ricci
*Attorney, Agent, or Firm*—Ken J. Pedersen; Barbara S. Pedersen

[57] ABSTRACT

The invention is a generally linear portable bow press which has a central turnbuckle section and a link chain section connected between two terminal cord or cable portions. Connected at the outside end of each cord or cable portion is a T-type handle which cooperates and engages with the limb groove at the end of a compound bow, the larger dimension of the T-type handle being oriented generally perpendicularly to the long line of the bow press. Between the inside end of one cord or cable portion and the central turnbuckle section is a length of link chain which adjustably connects to the turnbuckle section, permitting gross adjustment of the length of the bow press. The central turnbuckle section permits fine adjustment of the press, cooperating with the link chain section to allow the archer to exert an inward force on the bow press, and cause a flex in the bow while locking the bow against its reflex action. This way, the bowstring may become relaxed, and the bow and bowstring become available for maintenance.

5 Claims, 2 Drawing Sheets

PORTABLE BOW PRESS

BACKGROUND OF THE INVENTION

1. Technical Field

This invention relates generally to the sport of archery, and more specifically to bows of the compound type. The invention is a portable bow press which permits the archer to relieve tension on the compound bowstring for adjustment or repair of the bow or string.

2. Background Art

MAGNUM Bowstrings Co. of Nampa, Id., sells a portable bow press, called the Bow-Lock TM. This press is generally linear, and has a central link chain portion connected between two terminal cord portions. At the end of each cord portion is a generally cylindrical peg, oriented perpendicularly to the long line of the press, the peg being tied about its middle section by the end of the cord. To operate the Bow-Lock TM, the archer slips the peg on one end of the press through one limb groove at the end of the bow. Then, the archer flexes the bow to bring its ends together, and slips the peg on the other end of the press through the limb groove on the opposite end of the bow. Then, the archer relaxes the flex in the bow, and the pegs at the ends of the press catch and bind on the bow at the inside terminus of the limb grooves to lock the bow in place, with the bowstring relaxed and the bow ready for maintenance.

The length of the Bow-Lock TM may be adjusted by moving a master, locking link on the chain, with one end fixed, further down the chain to engage and lock with another link of chain. This way, a loop of excess chain is created along the length of the chain, shortening the press, up to the limit of the length of the chain. The reverse procedure may be done to lengthen the press. Besides the links on the chain, however, there is no other length-adjusting mechanism on the Bow-Lock TM.

Smith, U.S. Pat. No. 4,074,409, discloses a compound bow string changer which is a pull cord with sliding-locking bar and two attachment brackets.

Saunders, U.S. Pat. No. 4,195,397, discloses a compound bow stringer which is an improvement on the Smith device, due to a U-shaped handle on the sliding-locking bar and an elastic slack take-up device on the pull cord.

Rezmer, U.S. Pat. No. 4,599,987, discloses a compound bow string changer which is two cords attached to a rotatable lever and a variable-length adjustment rod. The rod is adjusted by a set screw in a clamp which slides along the rod.

Stevens, U.S. Pat. No. 5,022,377, discloses a portable bow press which is a brace with a threaded central aperture for receiving a threaded rod which engages and puts pressure on the bow handle to remove tension from the bow string.

Lint, U.S. Pat. No. 5,222,473, discloses a bow press which is similar in concept to the Stevens press discussed above, except the threaded rod of Stevens is replaced by two arms pivotally attached to a hydraulic ram.

Therefore, there is still a need in the archery art for a portable compound bow press which has both a gross and a fine length-adjusting mechanism.

DISCLOSURE OF INVENTION

The invention is a generally linear portable bow press which has a central turnbuckle section and a link chain section connected between two terminal cord or cable portions. Connected at the outside end of each cord or cable portion is a T-type handle which cooperates and engages with the limb groove at the end of a compound bow, the larger dimension of the T-type handle being oriented generally perpendicularly to the long line of the bow press. Between the inside end of one cord or cable portion and the central turnbuckle section is a length of link chain which adjustably connects to the turnbuckle section, permitting gross adjustment of the length of the bow press. The central turnbuckle section permits fine adjustment of the press, cooperating with the link chain section to allow the archer to exert an inward force on the bow press, and cause a flex in the bow while locking the bow against its reflex action. This way, the bowstring may become relaxed, and the bow and bowstring become available for maintenance.

BEST MODE FOR CARRYING OUT INVENTION

Figure 1:
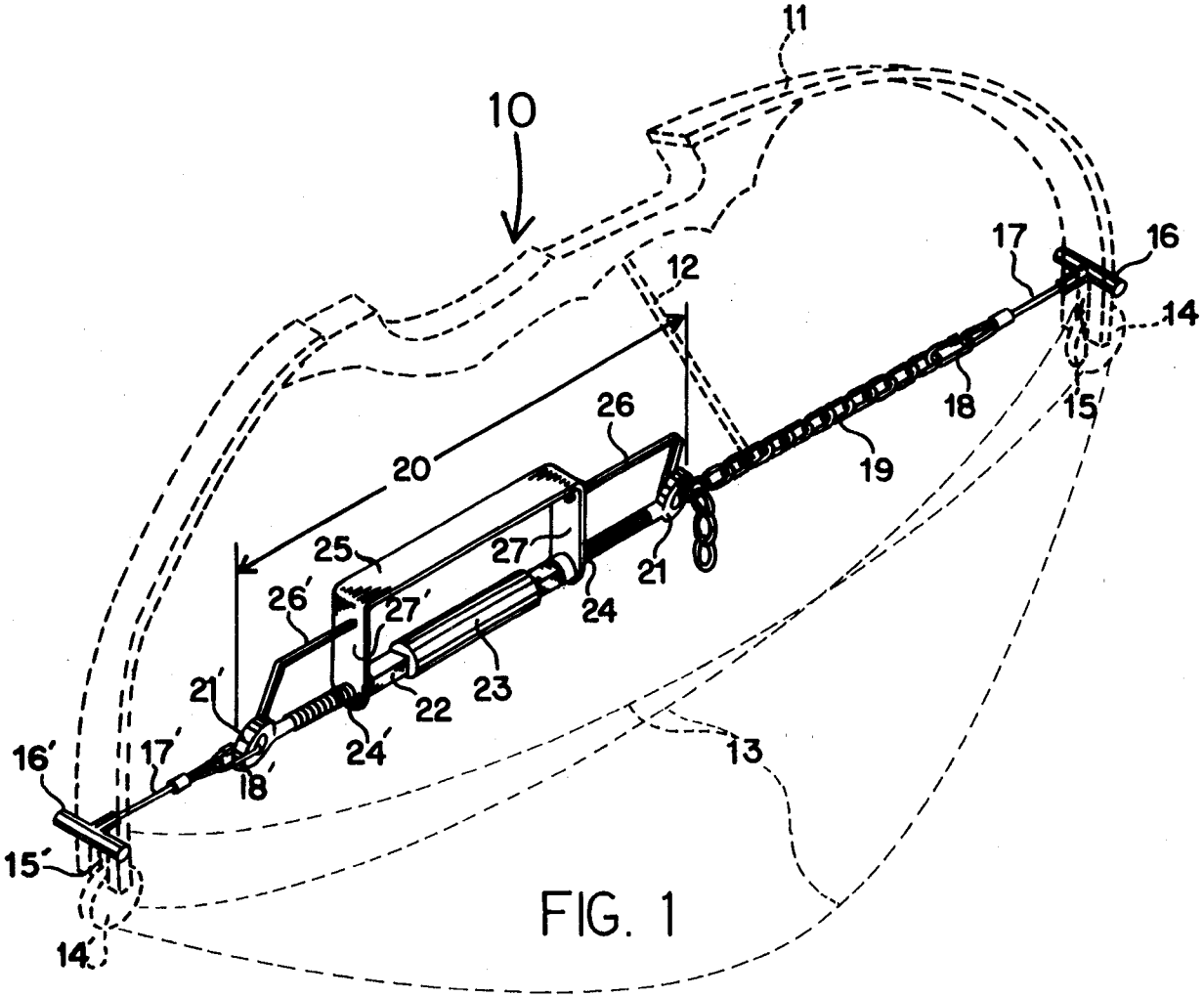
FIG. 1 is an isometric view of the portable bow press of this invention, attached to a compound bow which is shown in dotted lines.
Figure 2:
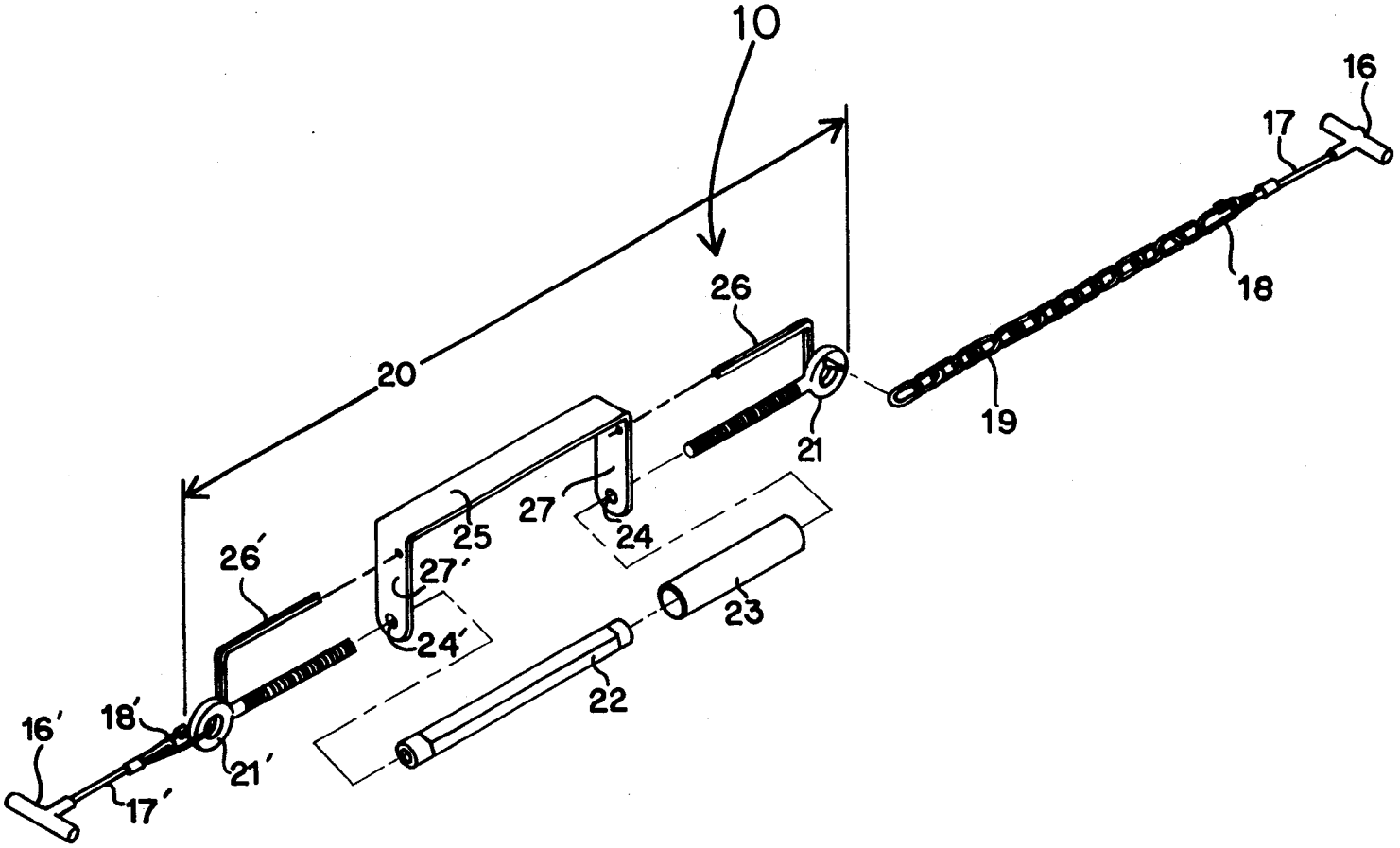
FIG. 2 is an exploded version of the bow press shown in FIG. 1, but without the bow.

Referring to the Figures, there is depicted generally portable bow press 10 connected to compound bow 11. Bow 11 is equipped with string dampener 12, bowstring 13 and two pulleys 14 and 14'. The pulleys are located in limb grooves 15 and 15', respectively, at the two ends of the limbs of the bow.

At the two ends of generally linear bow press 10 are T-type handles 16 and 16' which cooperate and engage with the limb grooves 15 and 15', respectively. Handles 16 and 16' are able to rotate on or with cables 17 and 17', respectively, so they may be rotated relative to cable clips 18 and 18', respectively. This way, handles 16 and 16' may be inserted in the limb grooves 15 and 15', respectively.

Near one end of bow press 10, for example, at cable clip 18 as depicted in FIG. 1, the cable clip is connected to a first end of a length of link chain 19. At its second end link chain 19 is adjustably connected to one end of turnbuckle assembly 20. The adjustable connection is obtained, for example, by making link chain 19 connectable to the turnbuckle assembly 20 at any link along the length of link chain 19. This way, the link chain 19 serves as a gross adjustment in the length of the bow press 10.

Turnbuckle assembly 20 has two eye-bolts, 21 and 21', with one eye-bolt, 21 as depicted in FIG. 1, being adjustably connected to the second end of link chain 19. Both eye-bolts 21 and 21' are threadedly connected, one on each end, to threaded sleeve 22. Threaded sleeve 22 may have optional pad 23 around it to protect the archer's knuckles from bumping sleeve 22 when operating the turnbuckle assembly 20.

Both eye-bolts 21 and 21' pass through holes 24 and 24', respectively in handle 25. Also, bent connecting rods 26 and 26' extend from the sides of the heads of eye-bolts 21 and 21', respectively, to sides 27 and 27', of handle 25. This way, handle 25, eye-bolts 21 and 21', and bent connecting rods 26 and 26' are together as a rigid unit, permitting all of them to be turned together. Consequently, a fine adjustment of the length of the bow press 10 may be made by turning handle 25 to turn eye-bolts 21 and 21', threading the eye-bolts out from sleeve 22 to lengthen the press, or threading the eye-bolts into sleeve 22 to shorten the press.

The bow press as above described may be made from conventional construction materials by conventional techniques.

The bow press 10 of this invention may be used in a similar manner as the Bow-Lock TM discussed above. First, one handle 16 is inserted in limb groove 15. Then, a gross adjustment is made in the length of chain link 19 by connecting the appropriate chain in the length to eye-bolt 21 so that handle 16' may barely be inserted in groove 15'. Then, handle 25 is turned in the direction which threads eye-bolts 21 and 21' into threaded sleeve 22, shortening the length of bow press 10. This way, the limbs of bow 11 may be flexed inwardly enough to allow bowstring 13 to become relaxed and available for maintenance. To replace tension on bowstring 13, the reverse procedure may be used.

While there is shown and described the present preferred embodiment of the invention, it is to be distinctly understood that this invention is not limited thereto but may be variously embodied to practice within the scope of the following claims.

I claim:

1. An adjustable, portable bow press, comprising:

first and second terminal cord or cable portions, each having an inside end and an outside end, the inside ends being oriented toward one another;

two engagement means, one connected at the outside end of each of said cord or cable portions, the engagement means being adapted to cooperate with a limb groove at an end of a compound bow;

a fine adjustment means comprising a central turnbuckle section with a first end and a second end, said turnbuckle section having at least one bolt threadedly connected to a threaded sleeve, being located between said two terminal cord or cable portions, and being connected on its first end to the inside end of said first terminal cord or cable portion; and a gross adjustment means comprising a length of material of adjustable length with a first end and a second end, said length of material being located between said two terminal cord or cable portions, being connected at its first end to the inside end of said second cord or cable portion, and being connected at its second end to the second end of said central turnbuckle section, said adjustable length of material permitting gross adjustment of the length of the bow press, and said turnbuckle permitting fine adjustment of the length of the bow press, wherein, when the length of the bow press is shortened, the said bow press flexes the compound bow to relieve tension on the compound bowstring.

2. The bow press of claim 1 wherein one of the two terminal cord or cable portions is rotatable relative to the corresponding engagement means to which it is connected.

3. The bow press of claim 1 wherein the two engagement means are T-type handles.

4. The bow press of claim 1 wherein the central turnbuckle section comprises two eye-bolts threadedly connected, one on each end, to a threaded sleeve.

5. The bow press of claim 4 which also comprises a handle extending from and connected to said two eye-bolts.

* * * * *